US006039484A

United States Patent [19]

Kageyama et al.

[11] Patent Number: 6,039,484

[45] Date of Patent: Mar. 21, 2000

[54] WRITING INSTRUMENT

[75] Inventors: Hidehei Kageyama; Yoshihide Mitsuya, both of Kawagoe, Japan

[73] Assignee: Kotobuki & Co., Ltd., Japan

[21] Appl. No.: 09/100,942

[22] Filed: Jun. 22, 1998

[51] Int. Cl.[7] ..... B43K 25/00

[52] U.S. Cl. ..... 401/52; 401/65; 401/67

[58] Field of Search ..... 401/52, 67, 65, 401/99, 109, 54, 247

[56] References Cited

U.S. PATENT DOCUMENTS

| | | | |
|---|---|---|---|
| 3,437,413 | 4/1969 | Parker | 401/67 |
| 4,018,536 | 4/1977 | Brenner | 401/292 |
| 4,957,384 | 9/1990 | Kageyama et al. | 401/65 |
| 5,022,774 | 6/1991 | Kageyama et al. | 401/52 |
| 5,915,870 | 6/1999 | Hamilton, Jr. | 401/54 |
| 5,947,620 | 9/1999 | Kageyama et al. | 401/67 |
| 5,988,913 | 11/1999 | Kageyama et al. | 401/52 |

*Primary Examiner*—Henry J. Recla
*Assistant Examiner*—Peter de Vore
*Attorney, Agent, or Firm*—Rothwell, Figg, Ernst, & Kurz, P.C.

[57] ABSTRACT

A writing instrument comprises a barrel provided with a tip element at the front thereof, a writing mechanism provided longitudinally movably within the barrel, a resilient element for biasing the writing mechanism backward, a knock member detachably mounted on the rear end of the writing mechanism, and a rattle-preventive means provided between a knock member and the barrel. The rattle of the knock member can be completely eliminated despite the presence of a clearance between parts such as between the knock member and the barrel or the tail crown.

28 Claims, 5 Drawing Sheets

WRITING INSTRUMENT

BACKGROUND OF THE INVENTION AND RELATED ART STATEMENT

The present invention relates to a writing instrument, and particularly to a writing instrument in which the tip of a writing element such as a writing lead is projected and withdrawn by operating a knock member at the rear end of the writing instrument to enable writing.

In the conventional rear-end knock type writing instrument of this kind, an internal mechanism provided with a writing element at the tip thereof relative to a barrel can be slidably moved by operation of a knock member. Therefore, there is formed a clearance between the knock member and the barrel in terms of construction.

Further, also in a writing instrument in which at the rear end of a barrel, a tail crown is mounted by threaded engagement with the barrel, and a knock member is slidably moved within the tail crown, there is likewise formed a clearance between the knock member and the tail crown.

As a result, the knock member rattles or rotates during the knocking operation due to the presence of the clearance to make it difficult to carry out the knocking operation positively. Further, in the case of a metallic knock member, the knock member freely moves vertically due to vibration produced in carrying and collides with other members to produce an unpleasing sound, "clattering".

In particular, in a double chuck type mechanical pencil, the rattle or rotation of the knock member is transmitted to a rear chuck for drawing out a lead so that the lead held between the front chuck and the rear chuck is sometimes twisted and broken.

OBJECT AND SUMMARY OF THE INVENTION

In view of the foregoing, a principal object of this invention is to overcome inconveniences in the writing instrument as described above and to provide a writing instrument which is allowed to completely remove the rattle of a knock member despite the presence of a clearance between parts, e.g., between the knock member and the barrel or the tail crown.

A further object of the present invention is to provide a writing instrument which is allowed to eliminate a displeasing sound, "clatter", caused by collision between parts in carrying in the case where a metallic knock member is used.

Another object of the present invention is to provide, in a writing instrument which is a double chuck type mechanical pencil, a writing instrument in which a lead held between a front chuck and a rear chuck is not possibly twisted and broken by rotation of a knock member.

Still another object of the present invention is to provide, also in the case of an engaging construction having a polygonal shape formed by an outer peripheral wall of a knock member and an inner peripheral wall of a tail crown or a barrel disposed externally thereof, which is employed as a normal detent construction for the knock member, a writing instrument capable of rendering a knocking operation having a high-class feeling in which, at the time of knocking, a knock cap does not slip down and knocking operation does not become heavy.

For achieving the aforementioned objects, a writing instrument according to one aspect of the present invention comprises a barrel provided with a tip element at the front thereof; a writing mechanism provided longitudinally movably within the barrel; a resilient element for biasing the writing mechanism backward; a knock member detachably mounted on the rear end of the writing mechanism; and a rattle-preventive means provided between the knock member and the barrel.

Further, a writing instrument according to one aspect of the present invention comprises a barrel provided with a tip element at the front thereof; a lead tank slidably provided within the barrel; a rear chuck fixedly mounted on the front end portion of the lead tank; a chuck ring loosely fitted in the rear chuck, a tubular means provided in the front outer periphery of said lead tank and interiorly provided with a rear resilient element for biasing the lead tank backward; a joint provided on said tubular means and formed in its inner periphery with a stop portion into which the tubular means and the chuck ring come contact and at which the tubular means and the chuck ring are stopped; a front chuck fixedly mounted on the front end portion of the joint; a front resilient element disposed relative to the tip element for biasing the joint backward, a tail crown provided at the rear end portion of the barrel; a knock member detachably provided at the rear of the lead tank; and a rattle-preventive means provided between the knock member and the tail crown.

Furthermore, a writing instrument according to one aspect of the present invention comprises a barrel provided with a tip element at the front thereof: a lead tank slidably provided within the barrel; a rear chuck fixedly mounted on the front end portion of the lead tank; a chuck ring loosely fitted in the rear chuck, a tubular means provided in the front outer periphery of said lead tank and interiorly provided with a rear resilient element for biasing the lead tank backward; a joint provided on said tubular means and formed in its inner periphery with a stop portion into which the tubular means and the chuck ring come contact and at which the tubular means and the chuck ring are stopped; a front chuck fixedly mounted on the front end portion of the joint; a front resilient element disposed relative to the tip element for biasing the joint backward; a tail crown provided at the rear end portion of the barrel; a knock member detachably provided at the rear of the lead tank, a detent means for rendering the knock member axially movable relative to the barrel but unrotatable; and a rattle-preventive means mounted on the knock member.

DETAILED DESCRIPTION OF THE PREFERRED EMBODIMENTS

Embodiments of the present invention will be described in detail hereinafter with reference to the accompanying drawings.

Figure 1:
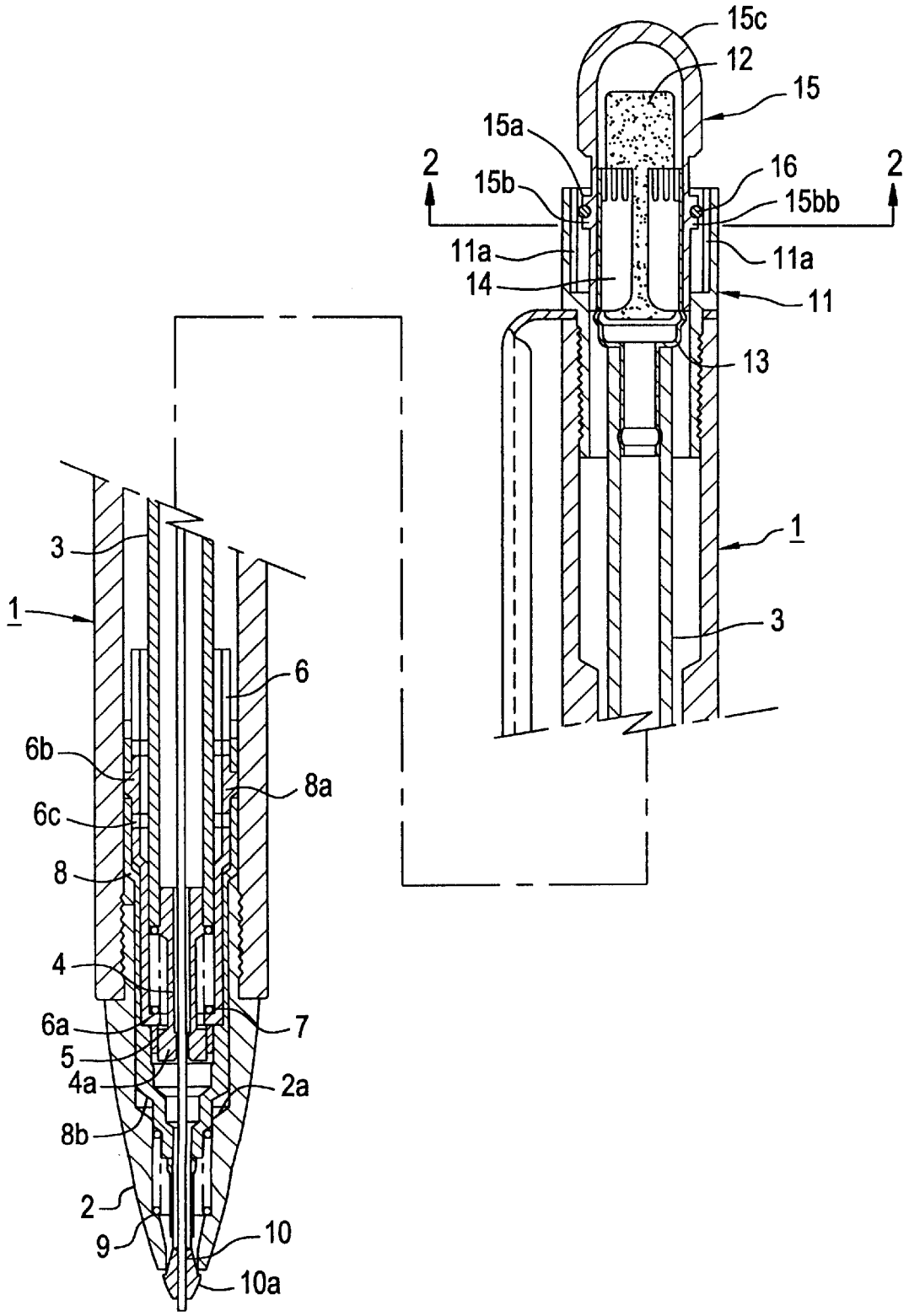
FIG. 1 is a longitudinal sectional view of a main part of a writing instrument according to an embodiment of the present invention.

FIGS. 1 to 5 shows one embodiment of the present invention. FIG. 1 is a longitudinal sectional view of a double chuck type mechanical pencil a part of which is omitted. A tip element 2 is threadedly mounted in the extreme end portion of a barrel 1. Further, a lead tank 3 is slidably provided within the barrel 1, and a knock mechanism described later is provided at the rear end portion of the lead tank 3. On the other hand, a rear chuck 4 is pressed in and secured to the extreme end portion of the lead tank 3, and a chuck ring 5 is loosely mounted on the extreme end portion 4a of the rear chuck 4.

Further, a rear spring 7 is intervened between a resilient tube 6 which is tubular means in contact with the rear end of the chuck ring 5, and the front end of the lead tank 3. More specifically, the resilient tube 6 has an inward flange 6*a* at the front end thereof, and the rear spring 7 as a resilient element is disposed internally of the flange 6*a* to bias the lead tank 3 and so on backward.

It is to be noted that the resilient tube 6 comprises a front small diameter portion, a rear large diameter portion, and an intermediate resilient portion therebetween to form a cushion sleeve as a whole. The intermediate resilient portion is bored with a plurality of pores 6*c* alternately in a diametral direction to have an axially expansible resilient function, and the intermediate resilient portion is formed in its outer peripheral portion with a pair of stopping protrusions 6*b*, which are stopped at a stopping through-hole 8*a* of a joint 8 described later.

The joint 8 is provided by a stopping construction externally of the resilient tube 6. More specifically, The joint 8 is formed in the front portion thereof with a small diameter step portion, an inclined shoulder portion 8*b* is provided at the rear of the small diameter step portion, and an intermediate diametral portion is formed continuously thereto. A large diameter portion is formed at the rearest portion, and the stopping through-hole 8*a* is bored in the side wall of the large diameter portion.

A front spring 9 as a resilient element is intervened between the extreme end of the small diameter step portion of the joint 8 and the inner wall portion of the tip element 2 to bias the joint 8 backward. In this embodiment, the force of the front spring 9 is set to be weaker than that of the rear spring 7 from a viewpoint of operation. Further, a lead-holding front chuck 10 is pressed in and secured to the extreme end of the small diameter step portion of the joint 8.

Then, in a state where the front chuck 10 is set to the tip element 2 and advances, the front chuck 10 holds the lead to a degree of preventing the lead from falling. However, when a slight load is applied to the lead, the front chuck 10 is formed to a degree that the lead moves. In a state that the front chuck 10 moves backward, the front chuck 10 has a holding force for holding the lead withstanding a writing pressure. A stopper protrusion 10*a* is formed on a portion of the front chuck which is projected from the extreme end of the tip element 2.

The function of stopper protrusion 10*a* will be described in detail. In a state that the front chuck 10 holds the lead as shown, the front chuck 10 is opened outward and projected from the tip element 2. However, in the state that the front chuck 10 does not hold the lead, the front chuck 10 is closed and moves backward. In this case, since the stopper protrusion 10*a* is present, the front chuck 10 is not possibly moved backward not more than as needed. Accordingly, there is no possibility that when the tip element 2 is removed, the front chuck 10 is fallen and lost.

Figure 2:
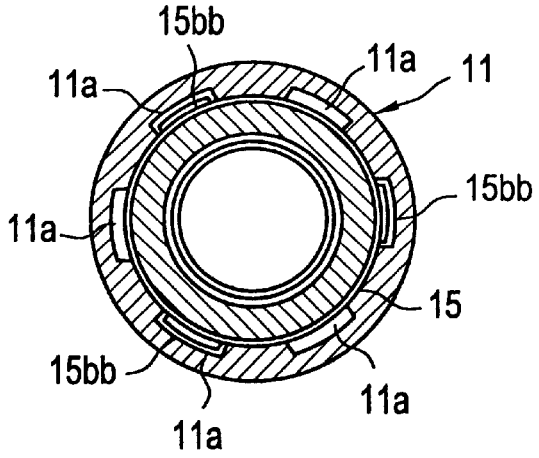
FIG. 2 is a cross-sectional view taken on line A—A of FIG. 1.
Figure 3:
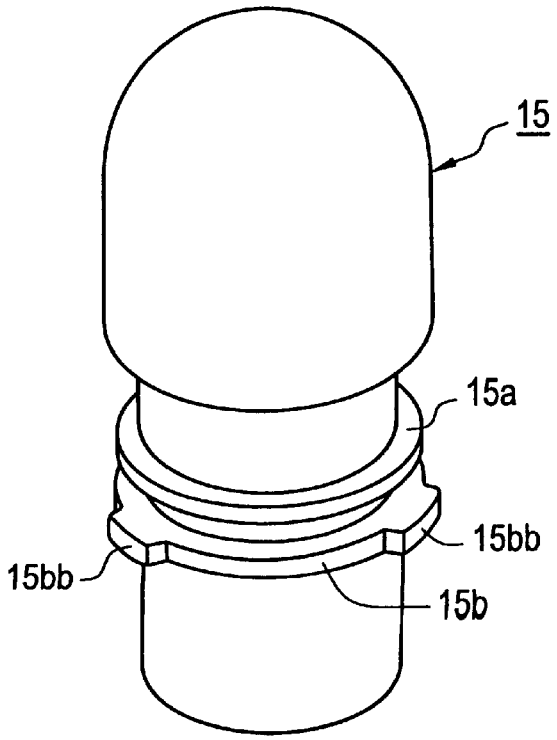
FIG. 3 is a perspective view of a knock cap.
Figure 4:
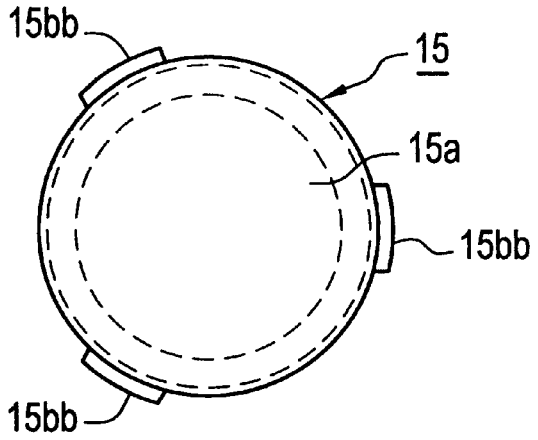
FIG. 4 is a plan view of a knock cap.
Figure 5:
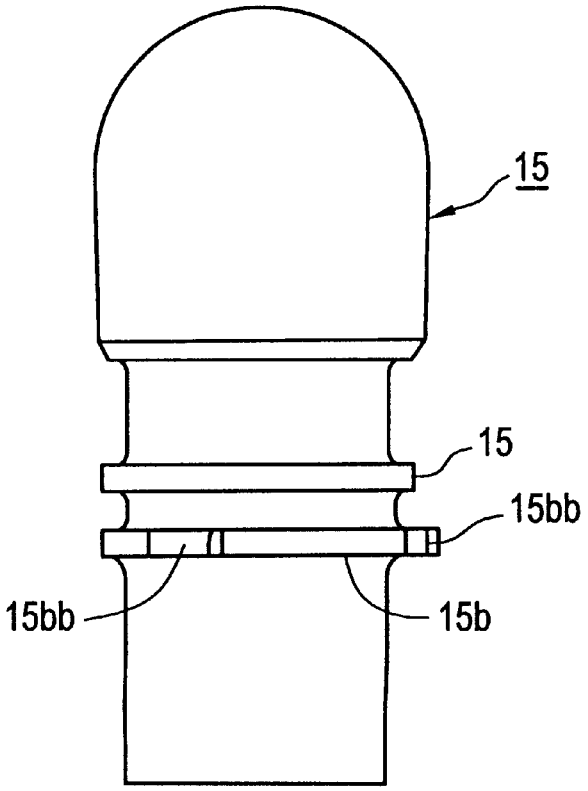
FIG. 5 is a side view of a knock cap.

Further, a tail crown 11 is threadedly mounted in the rear end of the barrel 1. The inner periphery of the large diameter portion at the upper part of the tail crown 11 is formed with six engaging grooves 11*a* in a longitudinal direction as shown in FIG. 2. On the other hand, an eraser holder 13 for holding an eraser 12 is pressed into the rear end of the lead tank 3. The eraser 12 with a metal jacket 14 is detachably mounted within the eraser holder 13, and a knock member or a knock cap 15 is detachably mounted between the eraser holder 13 and the tail crown 11.

Flange portions 15*a* and 15*b* spaced part in parallel are integrally formed in the outer periphery of the knock cap 15. Three engaging protrusions 15*bb* engaged with the internal engaging groove 11*a* of the tail crown 11 are formed, in the corresponding shape, externally of the flanges portion 15*b*. Accordingly, when the knock cap 15 is set to the eraser holder 13 within the tail crown 11, these engaging grooves 11*a* and the engaging protrusion 15*bb* are engaged with each other, so that the knock cap 15 is slidable lengthwise relative to the tail crown 11 but unrotatable. It is to be noted that a resilient O-ring 16 as rattle-preventive means is intervened in an annular groove 15*c* (FIG. 5) between the flange portions 15*a* and 15*b* of the knock cap 15.

In the following, the operation of the mechanical pencil according to the above embodiment of the present invention will be explained.

First, when in writing, the rear-end knock cap 15 is knocked, the front spring 9 is first compressed because the front spring 9 is formed to be weaker than the rear spring 7. The front chuck 10 is then advanced and opened to enable receiving the lead behind.

Thereafter, the inclined shoulder portion 8*b* of the joint 8 comes into contact with the step portion 2*a* formed internally of the tip element 2, the rear spring 7 is then compressed, and the rear chuck 4 is advanced along with the lead tank 3. The chuck ring 5 comes into contact with the step portion formed internally of the joint 8 during advancing of the rear chuck 4 to open the rear chuck 4, and the lead advances due to its own weight and is held. Thereafter, when the knocking is released, the rear chuck 4 returns to its initial position by being biased by the rear spring 7. Further, when the knocking is effected, the rear chuck 4 is advanced to hold the lead, in which state the rear chuck 4 is advanced within the joint 8 to deliver the lead.

The lead further advances within the front chuck 10, is held thereby and projected from the extreme end. When the lead becomes worn during writing, the knock cap 15 at the rear end may be again knocked to project the lead. When the lead becomes shortened in length, the knocking operation is repeated in a similar manner to feed a new lead within the lead tank 3 to push out the worn lead by the new lead so that the instrument can be further used continuously.

Note, in the event that the lead is excessively projected from the front chuck 10, the rear-end knock cap 15 can be pressed to slightly spread open the chuck, and after this, the lead tip can be pressed. Then the lead can be returned, and the projected part of the lead in length can be then adjusted to prevent the lead from being snapped.

In the event that the lead is stopped up due to the snapping, even if the attempt is made to turn the resilient tube 6 after the tip element 2 has been turned and removed from the barrel 1 to release the threaded engagement, the resilient tube 6 is obstructed from its rotation relative to the joint 8 so that the both are integrated because the stop protrusion 6*b* of the resilient tube 6 is stopped at the stopping through-hole 8*a* of the joint. Accordingly, even if the rear chuck 4 and the front chuck 10 hold one and the same lead, the lead is not twisted and broken. Note, particularly, when the resilient tube 6 has to be removed from the joint 8, it can be removed backward in the state that the pair of stop protrusions 6*b* of the resilient tube 6 are pressed inward in the diametral direction.

The above-described embodiment has the effects other than those of the engaging construction of the polygonal shapes of the tail crown and the knock cap which will be described later. That is, as is apparent from FIG. 2, the six axial engaging grooves 11*a* are formed equidistantly internally of the large diameter portion at the upper part of the tail crown 11. On the other hand, the knock cap 15 is removably fitted in the tail crown 11.

More specifically, the knock cap 15 is provided with the upper flange 15*a* and the lower flange 15*b* whose contours are formed thin and which are provided parallel to the outer periphery at the lower part inserted into the tail crown 11. Three engaging protrusions 15*bb* are formed at intervals of 120 degrees in the periphery of the lower flange 15*bb*. These engaging protrusions 15*b* are engaged with the engaging grooves 11*a* formed in the tail crown 11 when the knock cap 15 is inserted into the tail crown 11.

As a result, since the knock cap 15 is slidable axially relative to the tail crown 11 but locked in rotation, the rear chuck 4 (FIG. 1) pressed in and secured to the extreme end of the lead tank 3 is, after all, also locked in rotation so that the lead held along with the front chuck 10 (FIG. 1) is prevented from being broken due to the twisting.

Further, as shown in FIGS. 1 and 2, the resilient O-ring 16 such as rubber is fitted between the two flanges 15*a* and 15*b* of the knock cap 15. The knock cap 15 inserted into the tail crown 11 is positively pressed in contact with and held by the tail crown 11, due to the presence of the O-ring 16, to form no play therebetween, thus generating no metallic sound, "clatter", caused by shaking or the like.

Further, the three engaging protrusions 15*bb* are equidistantly formed only in the periphery of the lower flange 15*b*, as described above. Accordingly, this also provides the merit that in the case where the molded product of the knock cap 15 is a metal part formed by a die-cast, when it is put into a rotary barrel using pebbles or the like for removing burr, which is produced at the part, for finishing, there occurs no situation that the pebbles are caught in a gap between the flanges 15*a* and 15*b* and cannot be removed.

While in the above-described embodiment, six axial engaging grooves 11*a* of the tail crown 11 are formed, it is noted that if they are the number more than that of the engaging protrusions 15*bb* of the knock cap 15, the number thereof will suffice to be more or less than the above. After all, this provides the merit that with the increased number of grooves no consideration need be taken into the directivity of the engaging protrusions 15*bb* when the knock cap 15 is set to the tail crown 11. Further, while in the above-described embodiment, the engaging protrusions 15*bb* are provided merely on the lower flange 15*b*, it is of course that the former can be formed also on the upper flange 15*a*.

Furthermore, in the above-described embodiment, the detent function has been achieved by the engaging grooves 11*a* formed in the inner peripheral portion of the tail crown 11 and the engaging protrusions 15*bb* formed on the flange 15*b* of the knock cap 15. However, this can be achieved also by arrangement such that as the detent construction, the inner periphery of the tail crown 11 and the outer periphery of the knock cap 15 are respectively formed into a polygonal shape in cross section. In this case, the O-ring 16 is mounted on the knock cap 15 whereby in knocking, the knock cap 15 is not slipped out to cause knocking heavy, this enabling the knocking operation having an oppressive feeling.

Figure 6:
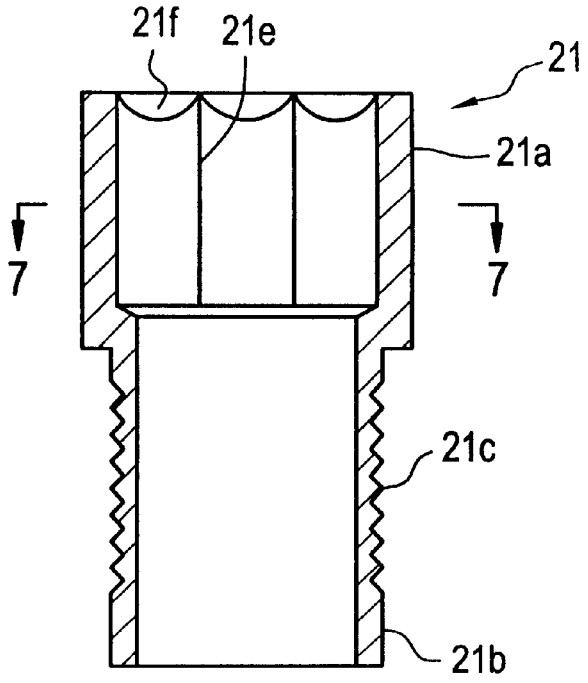
FIG. 6 is a longitudinal sectional view showing a tail crown according to a second embodiment of the present invention.
Figure 7:
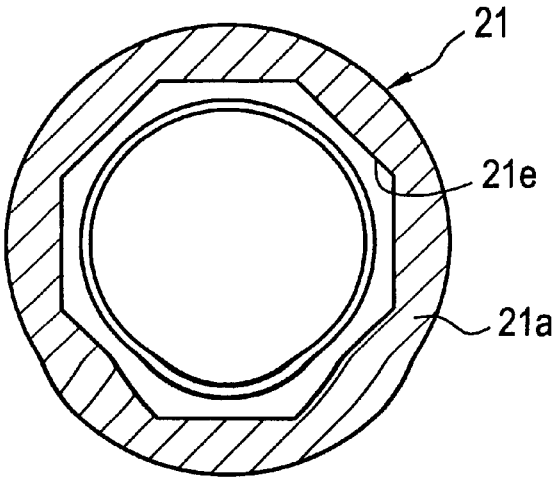
FIG. 7 is a sectional view taken on line B—B of FIG. 6.

FIGS. 6 and 7 show a tail crown 21 according to a second embodiment used for the aforementioned double chuck type mechanical pencil of the present invention, the tail crown 21 being mounted in the rear end of the barrel 1 by threaded engagement. This tail crown 21 comprises a head 21*a* projected from the barrel 1 and a leg 21*b*, and the leg 21*b* is formed in its outer periphery with an external thread 21*c* engaged with an internal thread in the inner periphery of the barrel 1. As shown in FIG. 7, the inner periphery 21*e* of the head 21*a* is of an octagonal shape. In FIG. 6, numeral 21*f* indicates a chamfer portion.

Figure 8:
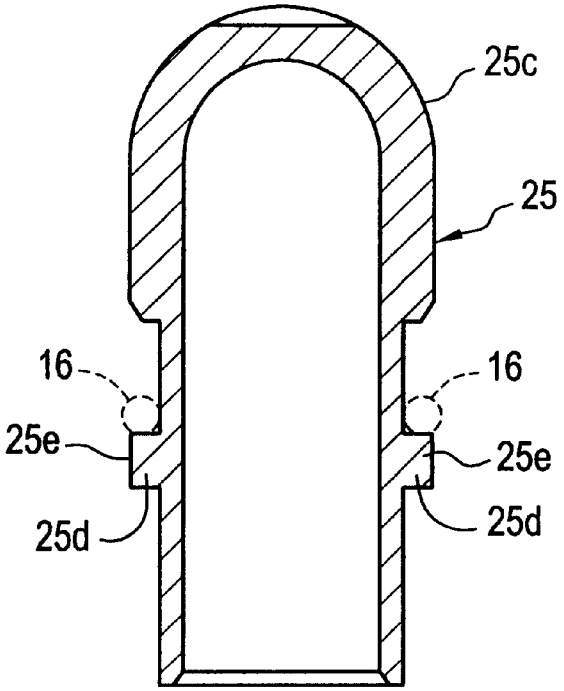
FIG. 8 is a longitudinal sectional view showing a knock cap used in conjunction with the tail crown shown in FIG. 6.
Figure 9:
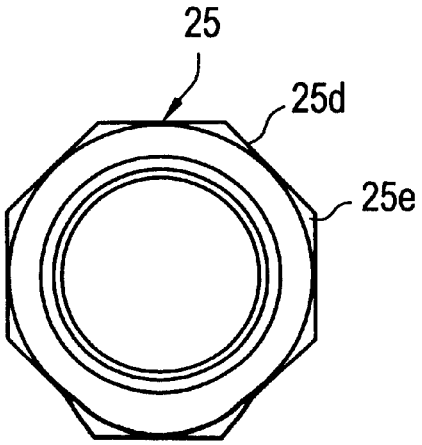
FIG. 9 is a bottom view of the knock cap shown in FIG. 8.

FIGS. 8 and 9 show a knock cap 25 used in conjunction with. This knock cap 25 has a head 25*c* formed into a hemispherical shape, and a rattle-preventive annular convex 25*d* is formed therebelow. The outer periphery 25*e* of the annular convex 25*d* is of an octagonal shape. In FIG. 8, a resilient O-ring 16 is indicated by dotted lines.

According to the second embodiment, since the outer periphery 25*e* of the rattle-preventive annular convex 25*d* of the knock cap 25 is of an octagonal shape, the inner peripheral portion 21*c* of the head 21*a* of the tail crown 21 is also of an octagonal shape and the outer periphery 25*e* and the inner peripheral portion 21*e* are engaged with each other, when a user rotates the knock cap 25 without intention, the knock cap 25 is not rotated relative to the tail crown 21. Therefore, no rotation is transmitted to the lead tank 3, so that the lead held between the rear chuck 4 and the front chuck 10 is not possibly twisted and snapped. Since both the knock cap 25 and the tail crown 21 have the polygonal shape, when the knock cap 25 is incorporated into the tail crown 21, the operator need not particularly be aware of the directivity of the parts to each other which is required, for example, when a rib is fitted in a groove, thus advantageously facilitating an assembly.

While in each of the above-described embodiments, an example of the engaging construction between the tail crown 11 and the knock member has been mentioned, this invention is not limited to such an example as described but is also applied to the case without the provision of the tail crown 11, that is, the direct engaging construction between the barrel 1 and the knock member.

While in the above-described embodiments, an explanation has been made of the double chuck type mechanical pencil, it is of course that this invention can be applied not only to other mechanical pencils of the rear end knock type instead of the double chuck type but also to other writing instruments such as a ball-point-pen. As described above, according to the present invention, despite the presence of the clearance between the parts such as between the knock member and the barrel or the tail crown, it is possible to make the knocking operation smooth by completely eliminating the rattle of the knock member, thus preventing an displeasing sound, "clatter", caused by carrying, and also eliminating a possible snapping of a lead in the double chuck type mechanical pencil.

Further, in the contact between the polygonal shapes to each other which are the normal detent construction, the knock cap is slipped off when knocking to make the knocking heavy. However, there is provided the effect in that those disadvantages as noted above can be overcome and the knocking operation having an oppressive feeling becomes enabled.

What is claimed is:

1. A writing instrument comprising:

a barrel;

a tip element provided at a front end of the barrel;

means axially movably incorporated within the barrel for advancing a writing medium:

a resilient element incorporated in the barrel for biasing the writing medium advancing means backward;

a knock member inserted in the rear end portion of the barrel and detachably mounted on the rear end of the writing medium advancing means;

the knock member having a pair of spaced apart flanges provided thereon;

cooperating means on the knock member and barrel for preventing the knock member from rotating relative to the barrel;

the cooperating means comprising engaging projection means mounted on the knock member, and engaging groove means formed in an inner portion of the barrel;

the engaging projection means and engaging groove means being engaged with each other, to thereby prevent the knock member from rotating relative to the barrel; and a rattle-preventive means provided between the pair of spaced apart flanges for preventing the knock member from rattling.

2. The writing instrument according to claim 1, wherein the rattle-preventive means comprises a resilient O-ring provided between the pair of spaced apart flanges.

3. The writing instrument according to claim 2, wherein the knock member has an annular groove formed between the pair of spaced apart flanges, and wherein the O-ring is fitted in the annular groove.

4. The writing instrument according to claim 1, wherein the engaging protrusion means comprises protrusions provided on at least one of the pair of spaced apart flanges.

5. The writing instrument according to claim 1, further including a tail crown mounted in rear end portion of the barrel to constitute the rear end portion of the barrel, the engaging groove formed in an inner surface of the tail crown.

6. The writing instrument according to claim 5, wherein the rattle-preventive means comprises a resilient O-ring provided between the pair of spaced apart flanges.

7. The writing instrument according to claim 6, wherein the knock member has an annular groove between the pair of spaced apart flanges, and wherein the O-ring is fitted in the annular groove.

8. The writing instrument according to claim 5, wherein the engaging protrusion means comprises protrusions provided on at least one of the pair of spaced apart flanges.

9. A writing instrument comprising:

a barrel;

a tip element provided at a front end of the barrel;

means axially movably incorporated within the barrel for advancing a writing medium;

spring means incorporated in the barrel for biasing the writing medium advancing means backward;

a knock member inserted in the rear end portion of the barrel and detachably mounted on the rear end of the writing medium advancing means;

cooperating means on the knock member and barrel for preventing the knock member from rotating relative to the barrel;

the cooperating means comprising a first peripheral surface of a polygonal shape formed on an outer periphery of the knock member, and a second peripheral surface of a polygonal shape formed on an inner periphery of the barrel;

the first peripheral surface and the second peripheral surface being engaged with each other, to thereby prevent the knock member from rotating relative to the barrel; and a rattle-preventive means provided between the pair of spaced apart flanges for preventing the knock member from rattling.

10. The writing instrument according to claim 9, wherein the rattle-preventive means comprises a resilient O-ring provided between the pair of spaced apart flanges.

11. The writing instrument according to claim 10, wherein the knock member has an annular groove formed between the pair of spaced apart flanges, and wherein the O-ring is fitted in the annular groove.

12. The writing instrument according to claim 9, further including a tail crown mounted in the rear end portion of the barrel to constitute the rear end portion of the barrel, the second peripheral surface formed on an inner periphery of the tail crown.

13. The writing instrument according to claim 12, wherein the rattle-preventive means comprises a resilient O-ring provided between the pair of spaced apart flanges.

14. The writing instrument according to claim 13, wherein the knock member has an annular groove between the pair of spaced apart flanges, and wherein the O-ring is fitted in the annular groove.

15. A double chuck type mechanical pencil comprising:

a barrel;

a tip element provided at the front end of the barrel;

a lead tank slidably incorporated within the barrel;

a rear chuck fixedly provided at the front end of the lead tank;

a chuck ring loosely mounted on the rear chuck;

tubular means incorporated in the barrel and having the front end portion of the lead tank received therein;

first spring means incorporated within the resilient tubular means for biasing backward an assembly comprising the lead tank and the rear chuck having the chuck ring loosely mounted thereon;

a joint incorporated in the barrel and mounted on the tubular means;

the joint formed on its inner periphery with a stop portion into which the chuck ring is to come contact during forward movement of the assembly;

a front chuck fixedly provided at the front end portion of the joint;

second spring means disposed between the tip element and the joint for biasing the joint backward;

a knock member inserted in the rear end portion of the barrel and detachably mounted on the rear end of the lead tank;

the knock member having a pair of spaced apart flanges provided thereon;

cooperating means on the knock member and barrel for preventing the knock member from rotating relative to the barrel;

the cooperating means comprising engaging projection means mounted on the knock member, and engaging groove means formed in an inner portion of the barrel;

the engaging projection means and engaging groove means being engaged with each other, to thereby prevent the knock member from rotating relative to the barrel; and a rattle-preventive means provided between the pair of spaced apart flanges for preventing the knock member from rattling.

16. The double chuck type mechanical pencil according to claim 15, wherein the rattle-preventive means comprises a resilient O-ring provided between the pair of spaced apart flanges.

17. The double chuck type mechanical pencil according to claim 16, wherein the knock member has an annular groove formed between the pair of spaced apart flanges, and wherein the O-ring is fitted in the annular groove.

18. The double chuck type mechanical pencil according to claim 15, wherein the engaging protrusion means comprises protrusions provided on at least one of the pair of spaced apart flanges.

19. The double chuck type mechanical pencil according to claim 15, further including a tail crown mounted in rear end portion of the barrel to constitute the rear end portion of the barrel, the engaging groove formed in an inner surface of the tail crown.

20. The double chuck type mechanical pencil according to claim 19, wherein the rattle-preventive means comprises a resilient O-ring provided between the pair of spaced apart flanges.

21. The double chuck type mechanical pencil according to claim 20, wherein the knock member has an annular groove between the pair of spaced apart flanges, and wherein the O-ring is fitted in the annular groove.

22. The double chuck type mechanical pencil according to claim 19, wherein the engaging protrusion means comprises protrusions provided on at least one of the pair of spaced apart flanges.

23. A double chuck type mechanical pencil comprising:

a barrel;

a tip element provided at the front end of the barrel;

a lead tank slidable incorporated within the barrel;

a rear chuck fixedly provided at the front end of the lead tank;

a chuck ring loosely mounted on the rear chuck;

tubular means incorporated in the barrel and having the front end portion of the lead tank received therein;

first spring means incorporated within the resilient tubular means for biasing backward an assembly comprising the lead tank and the rear chuck having the chuck ring loosely mounted thereon;

a joint incorporated in the barrel and mounted on the tubular means;

the joint formed on its inner periphery with a stop portion into which the chuck ring is to come contact during forward movement of the assembly;

a front chuck fixedly provided at the front end portion of the joint;

second spring means disposed between the tip element and the joint for biasing the joint backward;

a knock member inserted in the rear end portion of the barrel and detachably mounted on the rear end of the lead tank;

the knock member having a pair of spaced apart flanges provided thereon;

cooperating means on the knock member and barrel for preventing the knock member from rotating relative to the barrel;

the cooperating means comprising a first peripheral surface of a polygonal shape formed on an outer periphery of the knock member, and a second peripheral surface of a polygonal shape formed on an inner periphery of the barrel;

the first peripheral surface and the second peripheral surface being engaged with each other, to thereby prevent the knock member from rotating relative to the barrel; and a rattle-preventive means provided between the pair of spaced apart flanges for preventing the knock member from rattling.

24. The double chuck type mechanical pencil according to claim 23, wherein the rattle-preventive means comprises a resilient O-ring provided between the pair of spaced apart flanges.

25. The double chuck type mechanical pencil according to claim 24, wherein the knock member has an annular groove formed between the pair of spaced apart flanges, and wherein the O-ring is fitted in the annular groove.

26. The double chuck type mechanical pencil according to claim 23, further including a tail crown mounted in rear end portion of the barrel to constitute the rear end portion of the barrel, the second peripheral surface formed on an inner periphery of the tail crown.

27. The double chuck type mechanical pencil according to claim 26, wherein the rattle-preventive means comprises a resilient O-ring provided between the pair of spaced apart flanges.

28. The double chuck type mechanical pencil according to claim 27, wherein the knock member has an annular groove formed between the pair of spaced apart flanges, and wherein the O-ring is fitted in the annular groove.

* * * * *